US007677148B2

(12) United States Patent
Rizvi

(10) Patent No.: US 7,677,148 B2
(45) Date of Patent: Mar. 16, 2010

(54) TEARLESS ONION CHOPPER

(76) Inventor: Syed Rizvi, 200 N. Yale St., #112, Hemet, CA (US) 92544

( * ) Notice: Subject to any disclaimer, the term of this patent is extended or adjusted under 35 U.S.C. 154(b) by 246 days.

(21) Appl. No.: 11/880,515

(22) Filed: Jul. 23, 2007

(65) Prior Publication Data

US 2009/0025232 A1 Jan. 29, 2009

(51) Int. Cl.
*B26D 1/03* (2006.01)

(52) U.S. Cl. ..... 83/167; 83/858; 83/932

(58) Field of Classification Search ..... 83/167, 83/466.1, 522.11, 564, 597, 599, 613, 635, 83/651.1, 856–858, 932; 30/124, 299; 99/646 C, 99/506; 73/427; D7/672–675
See application file for complete search history.

(56) References Cited

U.S. PATENT DOCUMENTS 1,040,582 A * 10/1912 Rickert et al. ..... 99/509
3,814,316 A 6/1974 Brewer
3,942,399 A 3/1976 Giangiulio
3,949,637 A 4/1976 Funke
4,060,293 A 11/1977 Waiters
4,134,205 A 1/1979 Heling
4,257,216 A 3/1981 Eiker, Jr. et al.
4,470,345 A 9/1984 Miyata
4,602,559 A 7/1986 Suzuki et al.
4,704,959 A 11/1987 Scallen
4,873,918 A * 10/1989 Goldman ..... 99/403
5,089,286 A 2/1992 Geissler et al.
5,142,973 A 9/1992 Tur et al.
5,245,902 A 9/1993 Pereira
5,311,813 A 5/1994 Fairbanks et al.
5,337,480 A * 8/1994 Codikow ..... 30/114
5,375,512 A 12/1994 Ertmer
5,421,249 A 6/1995 Repisky et al.
5,461,971 A 10/1995 Brooks
5,606,908 A 3/1997 Mittnight
5,745,999 A 5/1998 Zirkiev
6,148,704 A 11/2000 Lewis
6,413,566 B2 * 7/2002 Caridis et al. ..... 426/518
6,435,080 B1 * 8/2002 Zarlengo ..... 99/510
6,467,711 B2 10/2002 Michel
6,585,179 B2 7/2003 Weibel
6,718,868 B2 4/2004 Ismail et al.
6,805,032 B2 10/2004 Engdahl
6,951,168 B1 10/2005 Tasakos
6,968,778 B2 11/2005 Karyo
D512,609 S 12/2005 Kaposi
2004/0016131 A1 1/2004 Hayashi
2005/0178865 A1 8/2005 Krause
2005/0205704 A1 9/2005 Yurchenco

OTHER PUBLICATIONS

Karen From Colorado, Instant Cooking Remedies, Jul. 2, 2005, RecipeZaar, visited on Sep. 22, 2009, http://www.recipezaar.com/bb/viewtopic.zsp?t=121005&postdays=0&postorder=asc&start=30&sid=56452c14d504479f1e2fae2bf131d338.*

* cited by examiner

*Primary Examiner*—Boyer D. Ashley
*Assistant Examiner*—Edward Landrum

(57) ABSTRACT

The present invention relates to methods and devices for cutting produce, such as onions and other vegetables. More particularly, the present invention relates to methods and devices for minimizing exposure to noxious and irritating gasses that are emitted from certain freshly cut produce, such as the syn-propanethial-S-oxide gas that is emitted by freshly cut onions. In certain preferred embodiments of the invention, a device is provided for cutting onions, which comprises (i) an open-ended container that is adapted to hold a liquid and (ii) a slicer that is capable of cutting onions when submerged in the liquid that is housed within the container.

2 Claims, 8 Drawing Sheets

TEARLESS ONION CHOPPER

FIELD OF THE INVENTION

The field of the present invention relates to methods and devices for cutting produce. More particularly, the present invention relates to methods and devices for minimizing exposure to noxious and irritating gasses that are emitted from certain freshly cut produce.

BACKGROUND OF THE INVENTION

It is well-known that various types of freshly cut produce emit noxious gasses that, for example, irritate eyes and cause unwanted tear production. Such gasses have also been implicated in abnormal vision, anxiety, fatigue, lack of concentration, mood disorders, decreased productivity, potential cardiovascular problems, and central nervous system abnormalities. Of course, these symptoms may affect the social, personal, and professional lives of individuals, particularly culinary professionals (and others working in the food industry).

Among the most well-known gasses is syn-propanethial-S-oxide, which is emitted from freshly cut onions. Indeed, most are familiar with the irritating and tear-causing sensation that results from cutting and chopping onions in open air. Syn-propanethial-S-oxide is both gaseous at room temperature and water soluble. The formation of syn-propanethial-S-oxide peaks at about 30 seconds after mechanical damage to an onion and completes its cycle of chemical evolution over the course of about five minutes. As the gas leaves the onion and begins to mix with the air, it may quickly contact and dissolve in the watery film that covers a person's eyes. This combination produces sulfuric acid, which irritates the nerve-endings found in the cornea, resulting in elevated tear production until such acid is sufficiently diluted and/or removed.

A number of devices have been developed in attempt to minimize the extent to which such gasses contact a person's eyes during onion cutting procedures. Many of these devices employ mechanical means, such as chambers, to trap such gasses in attempt to prevent eye contact. Other devices have used forced air to sweep away such gasses and prevent the same from contacting a person's eyes.

Many of these devices, however, suffer from one or more drawbacks. For example, many of these devices (i) are not able to prevent a substantial portion of the undesirable noxious gas from contacting a person's eyes, (ii) leave the gas trapped in a chamber which must later be cleaned (thereby potentially exposing the user to such gas during the cleaning process), (iii) are not adapted for household or individual use, and/or (iv) require the use of elaborate and expensive fans, motors, or other machinery. In light of the foregoing, a continuing need exists for improved devices and methods that may be used to cut produce while minimizing exposure to certain noxious gasses that are emitted by such freshly cut produce, e.g., minimizing exposure to the syn-propanethial-S-oxide gas that is emitted by freshly cut onions.

As the following will demonstrate, many of the foregoing needs are provided by the present invention.

SUMMARY OF THE INVENTION

According to a first aspect of the present invention, a device for cutting various types of produce is provided. The device of the present invention is particularly useful in cutting various types of produce, while minimizing exposure to noxious and irritating gasses emitted therefrom, such as the tear-causing gasses emitted by freshly cut onions. In certain preferred embodiments of the invention, the device comprises (i) an open-ended container that is adapted to hold a liquid (e.g., water or other appropriate solvent) and (ii) a slicer that is capable of cutting the produce while submerged in such liquid. The invention encompasses a first design whereby the produce is cut within the open-ended container while submerged in a liquid. The invention further comprises a second design whereby the produce is cut within a separate container including one or more cutting members, such as one or more blades, whereby the separate container is inserted into a container and submerged into a liquid housed therein.

In certain embodiments of the invention, the device further comprises a means for pushing the produce into and through the slicer or, alternatively, a means for pushing the slicer into and through the produce. In other words, the device of the present invention may further include a means for forcing the produce, e.g., onion, into contact with the slicer or, more particularly, the cutting members thereof, which causes the produce to be sliced, diced, or cut into multiple pieces.

According to another aspect of the present invention, methods for cutting produce and minimizing exposure to noxious gasses resulting therefrom are provided. The methods of the present invention generally comprise cutting at least one sample of produce, such as onion, into multiple pieces using a slicer, whereby such pieces are immediately forced and submerged into a liquid, such as water. In certain preferred embodiments of the invention, methods of reducing exposure to syn-propanethial-S-oxide, and the tear-causing effects thereof, while cutting onions are provided.

The above-mentioned and additional features of the present invention are further illustrated in the Detailed Description contained herein. All references disclosed herein, including U.S. patents and patent applications, are hereby incorporated by reference in their entirety as if each was incorporated individually.

DETAILED DESCRIPTION OF THE INVENTION

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to a first aspect of the present invention, a device is provided for cutting produce. The device of the present invention is particularly useful in cutting various types of produce, while minimizing exposure to noxious gasses, such as the tear-causing gasses emitted by freshly cut onions.

Figure 1:
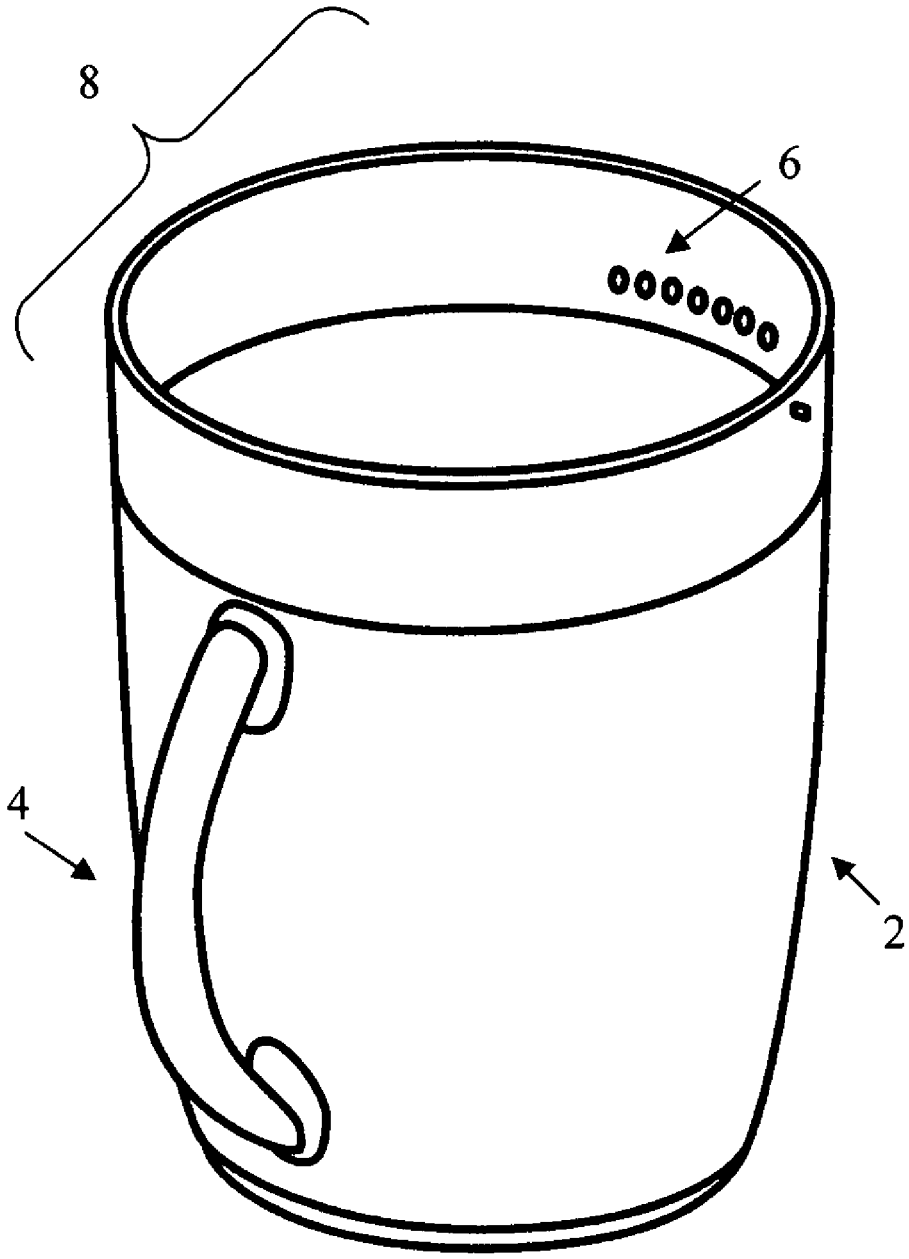
FIG. 1: A drawing of a non-limiting example of a container that may be used in connection with the present invention.

Referring to FIG. 1, the device comprises an open-ended container 2 that is adapted to hold a liquid. The container may, optionally, include a handle 4 or other means to assist in holding the container stationary during operation. In addition, the container preferably comprises one or more pores 6 through which the liquid contained therein may be drained. The container may be configured as a cylinder, having a circular-shaped opening (outer perimeter) 8. Those of ordinary skill in the art will appreciate, however, that any other configuration may be employed, such as square-shaped containers (or containers having an outer perimeter 8 of any other suitable shape).

Figure 2:
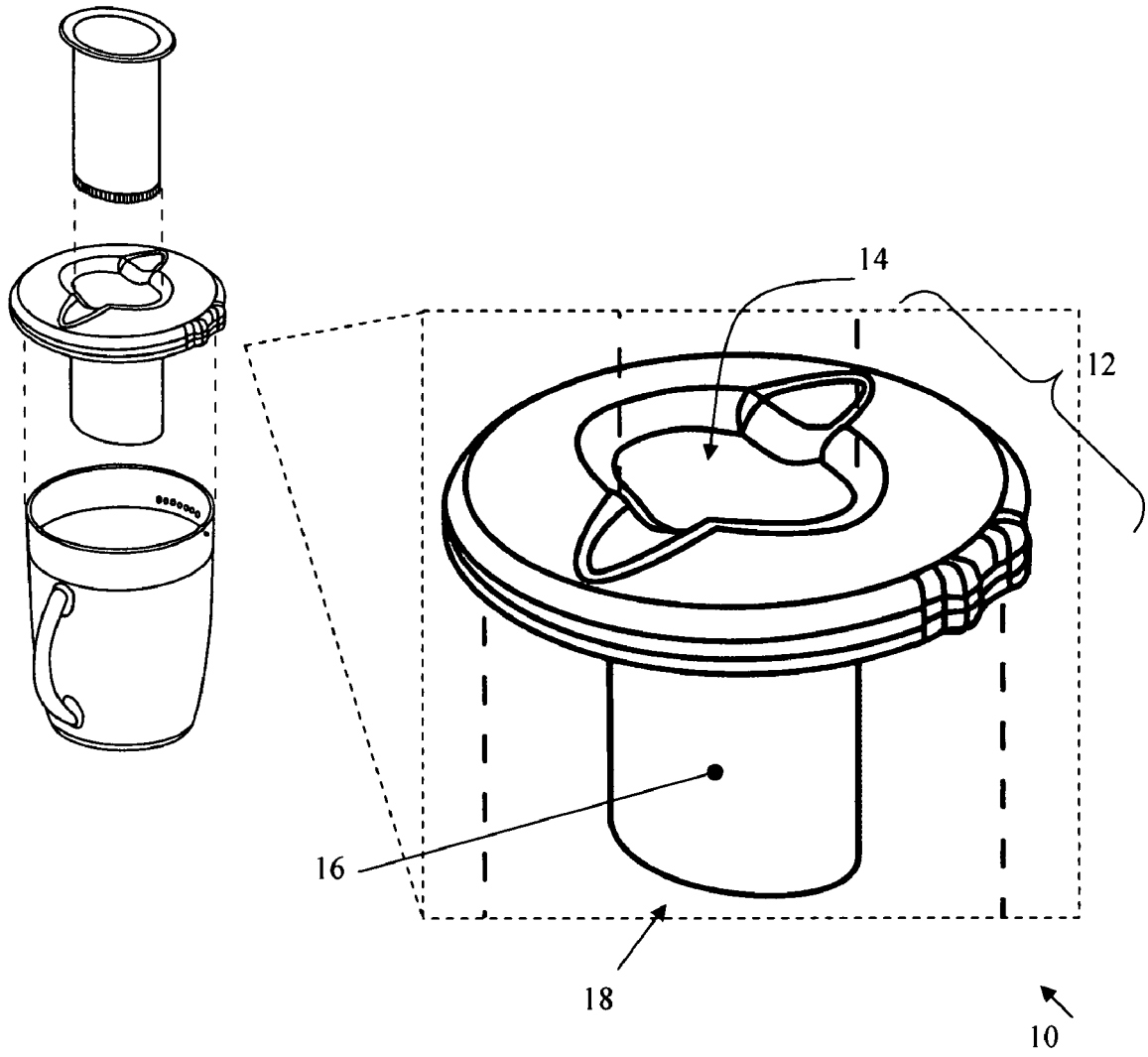
FIG. 2: A drawing of a non-limiting example of a slicer that may be used in connection with the present invention.

The device of the present invention further includes a slicer 10 that is capable of cutting a sample of produce when submerged in the liquid that is housed within the container 2. The slicer 10 is preferably configured to be removably placed within or directly adjacent to the opening of the container 2. Referring to FIG. 2, the slicer 10 shown therein comprises an outer perimeter 12, an area 14 that consists of or is adapted to receive a cutting member (not shown), and, optionally, a chamber 16 in which produce may be inserted. The cutting member preferably consists of a blade or rigid wire that may be used to slice produce. In the embodiment shown in FIG. 2, for example, the cutting member resides near the bottom portion 18 of the slicer 10. In such embodiments, the cutting member may be permanently or reversibly attached to the chamber 16.

Figure 3A:
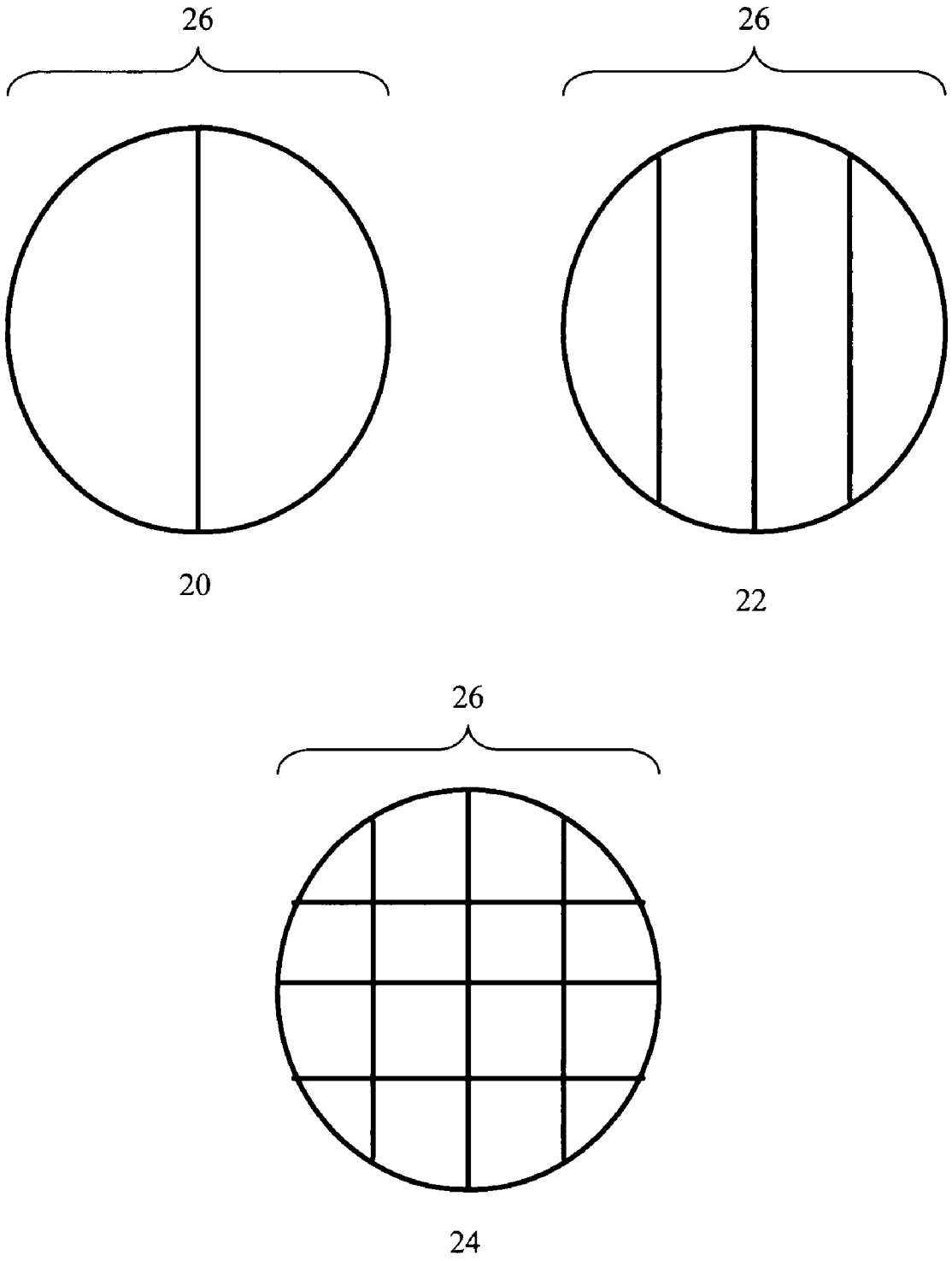
FIG. 3: A: A cross-sectional view of various non-limiting examples of cutting members that may be used in connection with a slicer described herein. B: A top-side view of the pusher, container, and slicer components described herein.

Referring to FIG. 3A, the cutting members used in the present invention may consist of a single blade 20, multiple parallel blades 22, or a grid of intersecting and parallel blades 24. As used herein, the term "blade" encompasses any rigid object capable of cutting produce, such as a sharpened edge, a rigid wire, or similar object. The cutting member has an outer perimeter 26 that is substantially similar in shape and size to the portion 18 of the slicer 10 in which the cutting member will reside. For example, the bottom portion 18 of the slicer 10 shown in FIG. 2 has a generally oval shape. Accordingly, the outer perimeter 26 of the cutting member in such embodiments will preferably have a corresponding oval shape. Of course, those of ordinary skill in the art will appreciate that the outer perimeter 26 of the cutting member, and the portion 18 of the slicer 10, may exhibit a circular, square, or other geometric shape, so long as the two are similar in shape and size to one another.

Figure 3B:
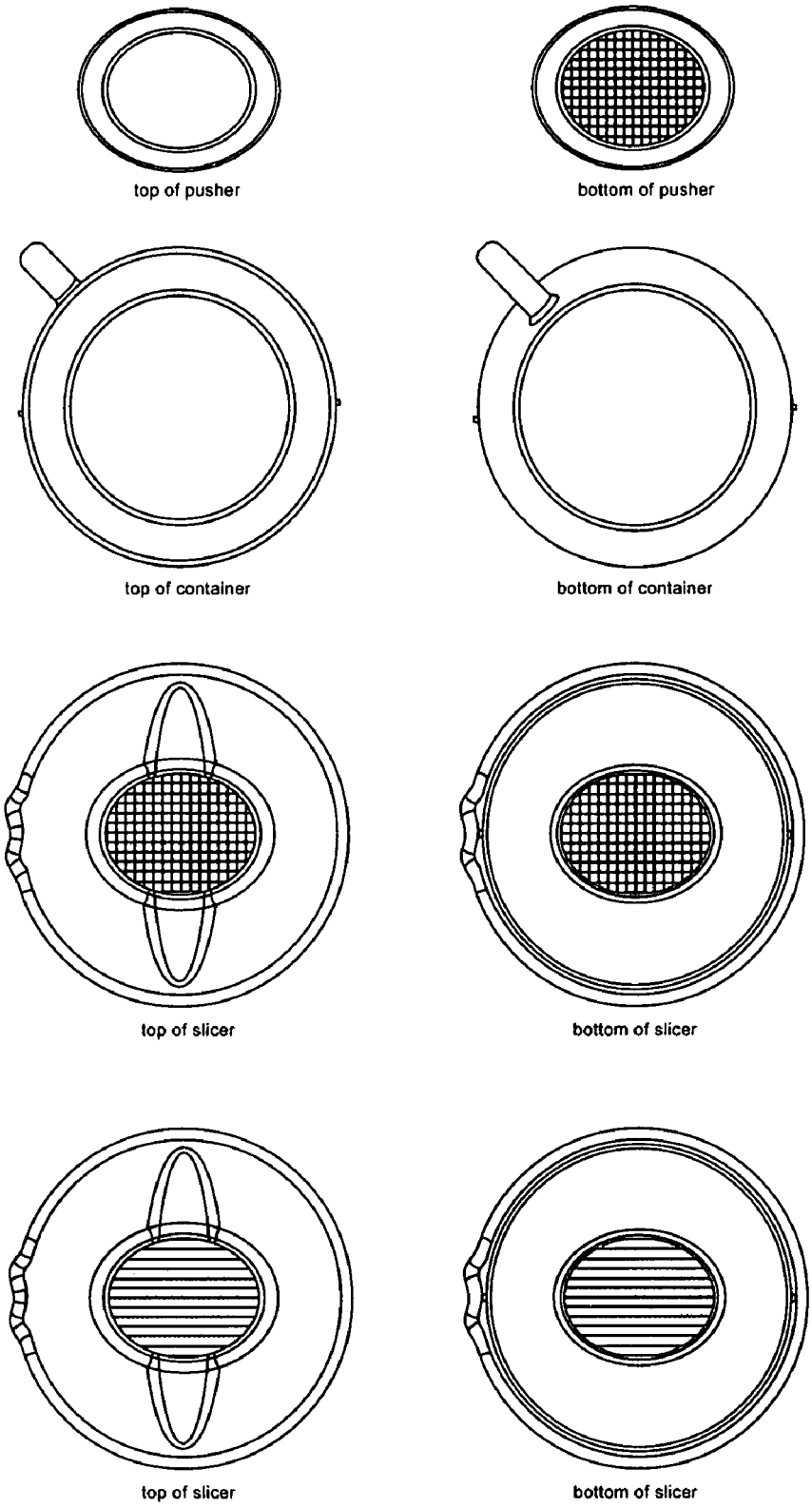

The invention provides that the cutting member is disposed within the slicer 10. In certain embodiments, the cutting member is formed integrally with the slicer 10, such that the cutting member is formed as a permanent component thereof. In other embodiments, the cutting member may be reversibly inserted into the slicer 10 vis-à-vis a mechanical engagement. For example, the portion 18 of the slicer 10 may be threaded, whereby the cutting member comprises a corresponding thread allowing it to be screwed into the bottom portion 18 of the slicer 10. In other embodiments, for example, the cutting member may be "snapped" into the bottom portion 18 of the slicer 10. When the cutting member may be reversibly inserted into the slicer 10, various cutting members exhibiting different blade configurations 20,22,24 may be selected by the operator of the device (in accordance with the size and type of produce slices the operator wishes to generate). See also FIG. 3B. Still further, the cutting members may be disposable (thereby avoiding the need to clean the cutting member following each use) or replaceable (such that dull blades resulting from continued use of the device may be replaced).

Figure 4A:
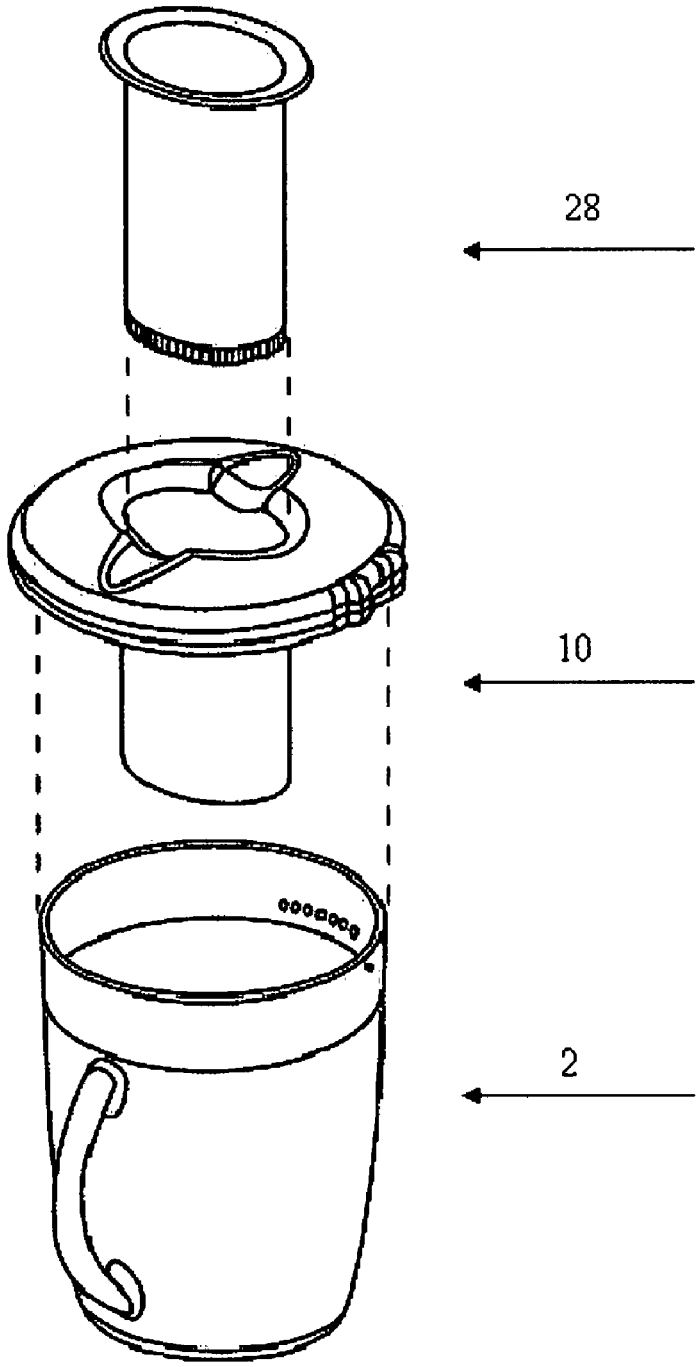
FIG. 4: A: A drawing illustrating the arrangement of the container, slicer, and pushing means described herein during operation. B: A drawing showing a slicer described herein being inserted into a container and secured thereto. C: A drawing showing a pushing means being inserted into a slicer that is disposed in a container.
Figure 4B:
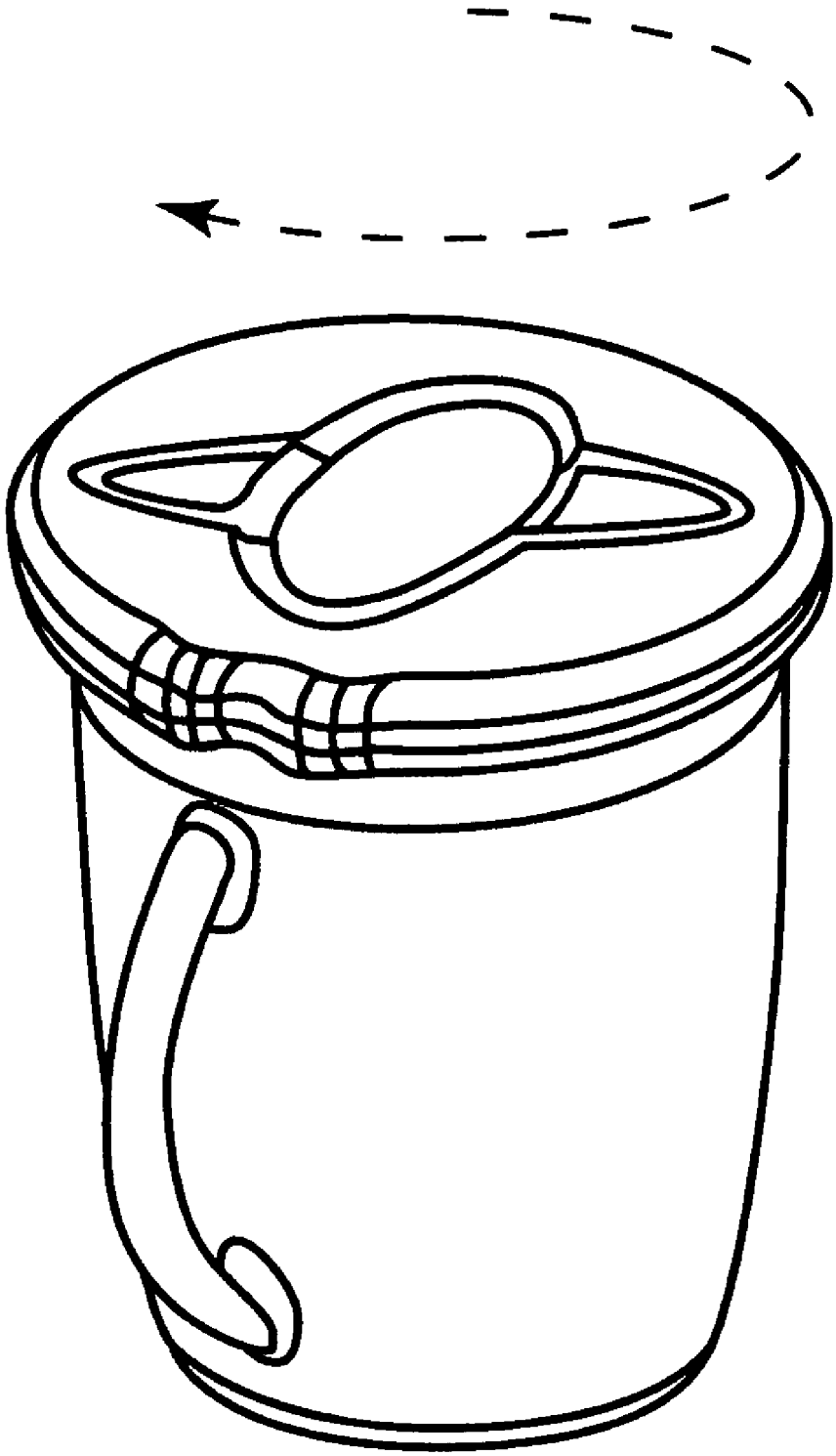

Referring to FIG. 2, the slicer shown therein includes an outer perimeter 12 that is similar in shape and size to the outer perimeter 8 of the container 2. Referring to FIGS. 4A-4B, when the outer perimeter 12 of the slicer 10 is similar in shape and size to the outer perimeter 8 of the container 2, the slicer 10 may be placed over and adjacent to the container 2. In this embodiment, the bottom portion 18 of the slicer 10 may be inserted into the container 2, such that the outer perimeter 12 of the slicer 10 rests on top of the container 2 (FIG. 4B).

In the foregoing embodiments of the present invention, the device comprises a slicer 10 having a chamber 16 that is configured to receive and hold produce. More particularly, the volume of the chamber 16 is sufficient to receive and hold a sample of produce, e.g., an onion, of typical dimensions.

Figure 4C:
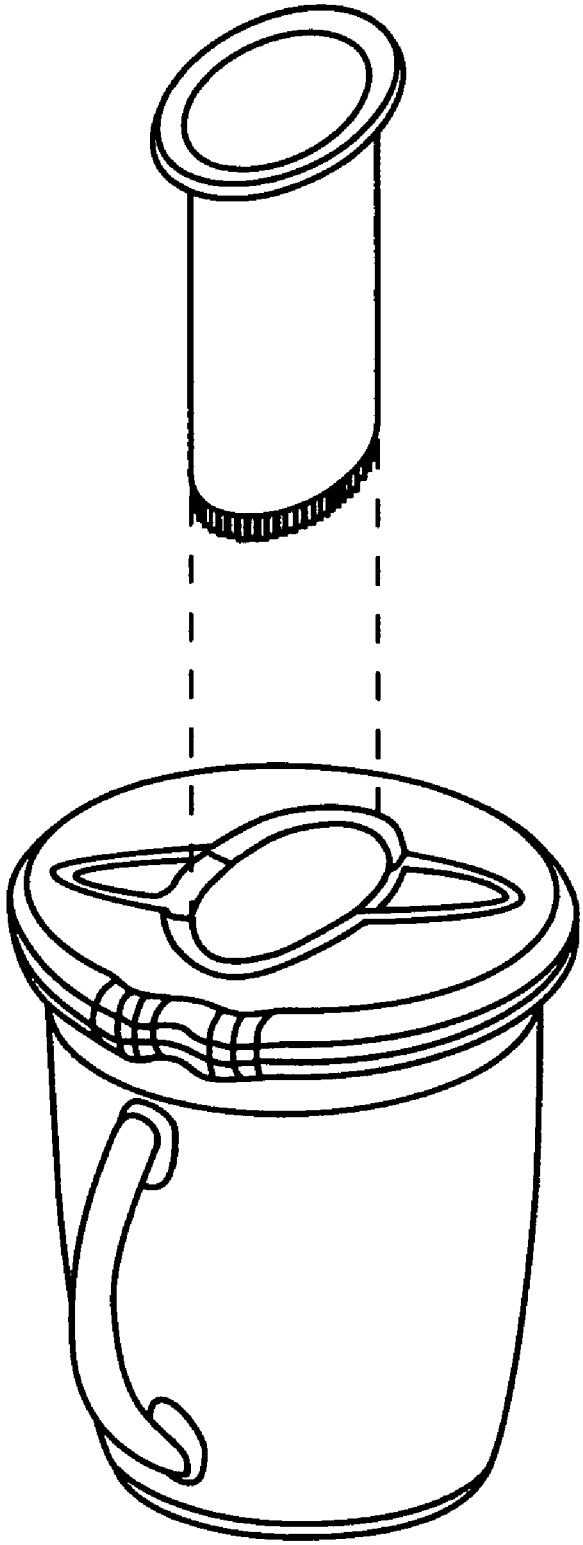
Figure 5:
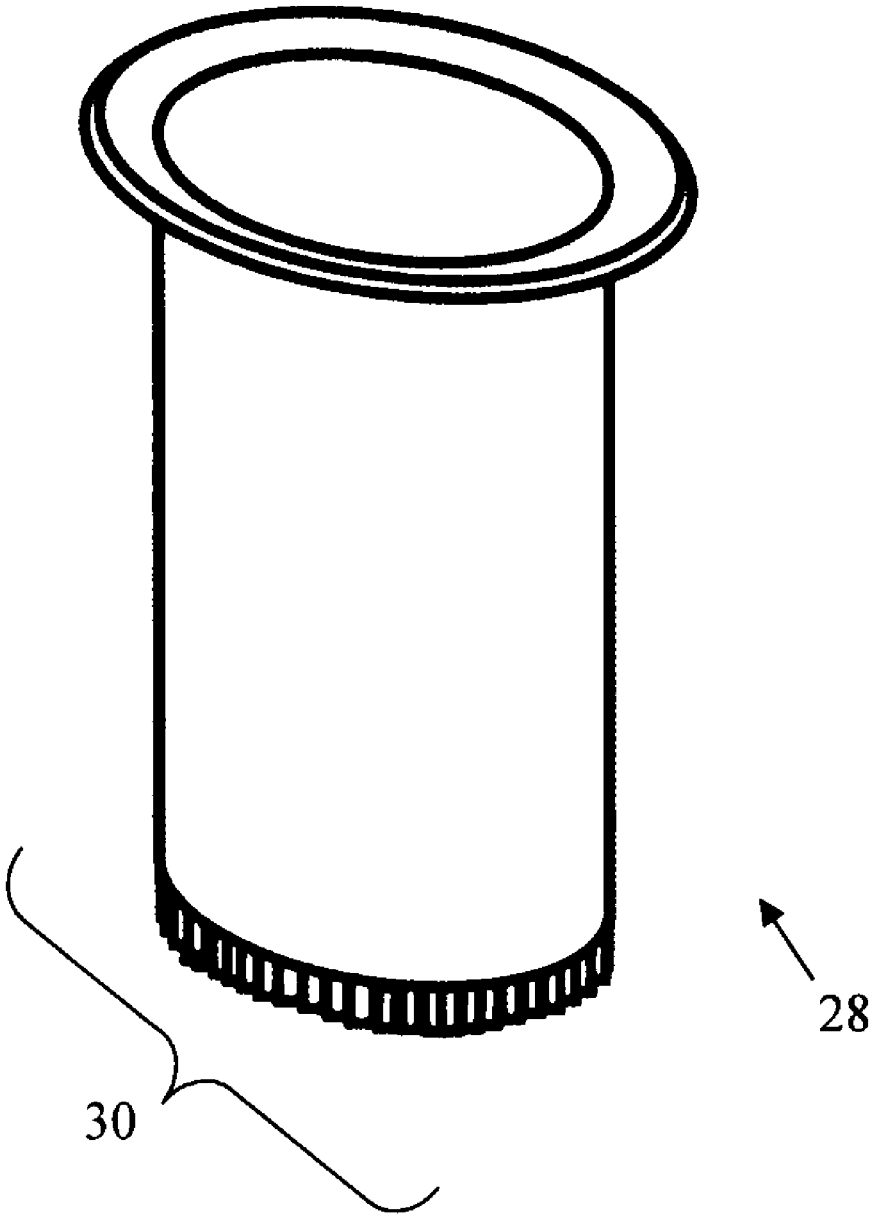
FIG. 5: A drawing of a non-limiting example of a pushing means that may be used in connection with the present invention.

The device of the present invention may further comprise a pushing means 28, also referred to herein as a "pusher," which may be used to force a sample of produce into and through the slicer 10. Referring to FIG. 5, for example, the pushing means 28 may comprise any rigid object that may be placed on top of a sample of produce when disposed, e.g., within the chamber 16 of a slicer 10, such that by applying force (or pressure) to the topside of the pushing means 28, the produce is forced into and through the cutting members of the slicer 10. The pushing means 28 is preferably configured to have an outer perimeter 30 that fits within the chamber 16 of the slicer 10 (FIG. 4C), such that the chamber 16 may receive the pushing means 28 as the produce is forced through the cutting members thereof.

In certain preferred embodiments, the device of the present invention may be operated by filling the container 2 with a liquid, e.g., water or any other appropriate solvent. A sample of produce may be washed and/or peeled, e.g., as in the case of an onion, under running tap water. The produce may then be placed within the chamber 16 of the slicer 10, which is placed adjacent to the container 2. More particularly, in certain preferred embodiments of the invention, the bottom portion 18 of the slicer 10 is inserted into the container 2, such that the outer perimeter 12 of the slicer 10 is adjacent to and rests upon the outer perimeter 8 of the container 2.

The pushing means 28 may then be placed on top of the sample of produce, whereby an operator may press or force the pushing means 28 downward, thereby forcing the produce into and through the cutting members that are located near the bottom portion 18 of the chamber 16. By forcing the produce into and through the cutting members, the produce is cut into pieces and immediately extruded into the liquid within the container 2. Moreover, any noxious and irritating gas emitted by such freshly cut produce, such as the irritating gas emitted by freshly cut onions, is immediately dispersed into and dissolved in the liquid (thereby avoiding dispersion thereof into the air and contacting a person's eyes and nasal cavity). The liquid (containing the dissolved gas) may then be drained out of the container 2 through the pores 6 located therein (leaving the cut produce pieces behind). In certain alternative embodiments, the slicer 10 may be removed from the container 2, a screen may be placed on top of the container 2, and the container 2 may be inverted, thereby allowing the liquid to drain therefrom (while retaining the cut produce pieces).

In certain alternative embodiments of the invention, the slicer 10 does not include a chamber 16. In such alternative embodiments, the produce may be submerged in liquid and placed directly in the container prior to cutting, whereby the slicer 10 consists of an outer perimeter 12 and cutting member disposed therein, which may be applied and forced through the produce while submerged in the liquid that is housed within the container 2.

The device of the present invention, including all components thereof, such as the container 2, slicer 10, and pushing means 28, may be constructed of any suitable material, such as stainless steel, plastic, other polymers, or combinations of the foregoing. Preferably, the device is constructed of a material that may be washed in conventional dish washing machines.

In accordance with other preferred embodiments of the present invention, methods for cutting produce and minimizing exposure to noxious gasses resulting therefrom are provided. More particularly, the methods of the present invention generally comprise cutting at least one sample of produce into multiple pieces using a cutting means, wherein said pieces are immediately forced and submerged into a liquid. When the produce is cut into pieces and forced into a liquid, the gas that is emitted therefrom immediately diffuses into and is solubilized by the liquid (thereby avoiding the dispersion thereof into the surrounding air and contact with a person's eyes, nasal cavity, etc.). The present invention exploits and makes use of the tendency of a gas, when exposed to a liquid, such as water, to immediately become dissolved in the liquid.

The device and cutting means used to cut at least one sample of produce into multiple pieces, while submerged in a liquid, may be carried out using the devices described herein. Preferably, the liquid used in connection with the methods of the present invention is water. However, those of ordinary skill in art will appreciate that the construction and design of such device may vary, while still allowing produce to be cut into multiple pieces while submerged in a liquid, thereby avoiding the dispersion of noxious and irritating gas into the air.

In certain preferred embodiments, the devices and methods of the present invention are used to cut onions, thereby avoiding and/or reducing the extent to which an operator is exposed to syn-propanethial-S-oxide (the noxious gas that is emitted by freshly cut onions). Syn-propanethial-S-oxide, a.k.a. ethyl sulfine, is both gaseous at room temperature and water soluble.

The formation of syn-propanethial-S-oxide peaks at about 30 seconds after mechanical damage to the onion and completes its cycle of chemical evolution over about five minutes. As the gas leaves the onion and begins to mix with the air, it may quickly contact and dissolve in the watery film that covers a person's eyes. This combination produces sulfuric acid, which irritates the nerve-endings found in the cornea, resulting in elevated tear production until such acid is sufficiently diluted and/or removed. The devices and methods described herein cause syn-propanethial-S-oxide emitted by freshly cut onions to be immediately dispersed into and dissolved within a liquid during a cutting operation.

In other embodiments, the methods of the present invention may be used for cutting other types of produce that emit noxious and/or irritating gasses. For example, the invention may be used to cut garlic, leeks, or pepper, while submerged in a liquid in order to avoid the noxious and/or irritating gas that is emitted therefrom. For example, the devices and methods of the present invention may be used to cut pepper, thereby avoiding and/or reducing the extent to which a person is subjected to the irritating chemicals emitted therefrom, which causes nasal irritation, sneezing, and other undesirable symptoms. More specifically, by using the devices and methods of the present invention, pepper samples may be easily cut while submerged in a liquid, thereby avoiding the dispersion of irritating chemicals into the air (and, therefore, preventing the irritating chemicals from contacting a person's mucous membranes.

Similar to the device of the present invention, the methods of the invention may be carried out by filling a container with a liquid, preferably water or any other appropriate solvent. A sample of produce may be cleaned and/or peeled, such as in the case of an onion, under running tap water. Next, the sample of produce is placed within the chamber of a cutting means, such as, but not limited to, the slicer 10 shown in FIG. 2, which is placed adjacent to the container. The cutting means preferably includes a cutting member comprising one or more blades, as described above, whereby pushing the sample of produce into and through the cutting member generates a plurality of freshly cut produce pieces. Preferably, when the produce is cut using and/or within the cutting means, the produce is submerged within or in close proximity to the liquid housed within the container, such that the cut pieces are immediately forced into liquid. As described herein, by cutting the produce while submerged in (or in close proximity to) the liquid, the noxious and irritating gas emitted therefrom is immediately dispersed into and dissolved in the liquid (such as the syn-propanethial-S-oxide gas emitted by freshly cut onions). Once the cutting procedure has been completed, the liquid (containing the dissolved gas) may be decanted, drained, and/or poured out of the container and disposed of, preferably using a screen or series of pores located within the container, such that the cut produce pieces are left behind.

Similar to the devices of the present invention, the methods of the invention provide that a pushing means, such as, but not limited to, the pushing means 28 shown in FIG. 5, may be placed on top of a produce sample, whereby an operator may press or force the pushing means downward and through the cutting members of a cutting means (which cuts the produce into several pieces). Alternatively, the methods of the invention provide that the cutting means itself, which comprises the cutting members, may be applied to and forced through the produce, whereby the produce is cut into a plurality of pieces and immediately displaced into the liquid.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A device for cutting onion, which comprises:

(a) a container having an opening at a topside thereof, wherein the container: (i) contains a volume of water, (ii) has an outer perimeter that is substantially circular in shape, and (iii) includes a plurality of pores through which the water may be drained;

(b) a slicer capable of holding and cutting at least one onion, wherein the slicer; (i) has an outer perimeter that is substantially circular in shape and is configured to be placed adjacent to the opening of the container, (ii) has an inner chamber, which is configured to hold at least one onion, inserted into the container, and (iii) comprises a set of parallel blades capable of cutting the at least one onion; and (c) a means for pushing the at least one onion into and through the slicer to produce a plurality of onion pieces, the onion pieces being forced into the container by the means for pushing, wherein the at least one onion is submerged in the water housed in the container during cutting.

2. The device of claim 1, wherein the set of parallel blades may be reversibly inserted into the inner chamber.

* * * * *